US010199708B2

(12) United States Patent
Tornielli di Crestvolant et al.

(10) Patent No.: US 10,199,708 B2
(45) Date of Patent: Feb. 5, 2019

(54) MULTIPORT DISTRIBUTION NETWORK

(71) Applicant: European Space Agency, Paris (FR)

(72) Inventors: Vittorio Tornielli di Crestvolant, Noordwijk (NL); Michael Lancaster, Noordwijk (NL); Petronilo Martin Iglesias, Noordwijk (NL)

(73) Assignee: European Space Agency, Paris (FR)

( * ) Notice: Subject to any disclaimer, the term of this patent is extended or adjusted under 35 U.S.C. 154(b) by 0 days.

(21) Appl. No.: 15/213,071

(22) Filed: Jul. 18, 2016

(65) Prior Publication Data

US 2017/0033427 A1 Feb. 2, 2017

(30) Foreign Application Priority Data

Jul. 30, 2015 (GB) ..... 1513395.2

(51) Int. Cl.
*H01P 5/12* (2006.01)
*H01P 5/18* (2006.01)
(Continued)

(52) U.S. Cl.
CPC ..... *H01P 5/12* (2013.01); *H01P 1/207* (2013.01); *H01P 5/181* (2013.01); *H01P 5/227* (2013.01);
(Continued)

(58) Field of Classification Search
CPC .. H01P 5/12; H01P 5/181; H01P 5/227; H01P 1/207; H01P 11/002; H01P 11/007; H01P 11/008
(Continued)

(56) References Cited

U.S. PATENT DOCUMENTS 6,381,538 B1 4/2002 Robinson et al.
2002/0039072 A1 4/2002 Gremmert et al.
(Continued)

FOREIGN PATENT DOCUMENTS

JP 2007104290 A 4/2007

OTHER PUBLICATIONS

Vittorio Tornielli Di Crestvolant et al ; Advances in Manufacturing 4X4 Bulter Matrices with Inherent Bandpass Filter function, INternational Workshop on Microwave Filters, Mar. 23, 2015 pp. 1-5.*
(Continued)

*Primary Examiner* — Robert J Pascal
*Assistant Examiner* — Kimberly E Glenn
(74) *Attorney, Agent, or Firm* — Park, Vaughan, Fleming & Dowler LLP

(57) ABSTRACT

A multiport distribution network is provided that supports N inputs and N outputs, where N>1, the multipart distribution network providing an independent distribution path extending from each input to each output, each path being formed from a sequence of at least two fundamental units. Each fundamental unit comprises a circuit formed of multiple resonator cavities and having n input ports for receiving respective input signals, and n output ports for outputting respective output signals, where n>1, and wherein the circuit is configured to: (i) at each input port, split an input signal received at that input port into n equal signal components and provide each of the n signal components to a respective output port of the circuit; and (ii) at each output port, combine the signal components received from the n input ports to form an output signal for that output port. The multipart distribution network is configured to apply the same filter transfer function along each independent distribution path.

26 Claims, 16 Drawing Sheets

(51) Int. Cl.

| | |
|---|---|
| ***H01P 5/22*** | (2006.01) |
| ***H01P 7/06*** | (2006.01) |
| ***H01P 1/207*** | (2006.01) |
| ***H01P 11/00*** | (2006.01) |

(52) U.S. Cl.
CPC ..... *H01P 7/06* (2013.01); *H01P 11/002* (2013.01); *H01P 11/007* (2013.01); *H01P 11/008* (2013.01)

(58) Field of Classification Search
USPC ..... 333/132
See application file for complete search history.

(56) References Cited

U.S. PATENT DOCUMENTS

| | | | | |
|---|---|---|---|---|
| 2004/0044445 | A1 | 3/2004 | Burdon | |
| 2007/0162197 | A1 | 7/2007 | Fleming | |
| 2009/0160576 | A1 | 6/2009 | Dent | |
| 2009/0207077 | A1* | 8/2009 | Hwang | H01Q 3/40 342/374 |
| 2010/0152931 | A1 | 6/2010 | Lacombe et al. | |
| 2011/0054718 | A1 | 3/2011 | Bailey | |
| 2016/0049715 | A1* | 2/2016 | Hundsdorfer | H01P 5/12 333/137 |

OTHER PUBLICATIONS

EPO, Application No. 13868061.6, Extended European Search Report, dated Dec. 13, 2016.
Donald W. McCann, "Percent Power Increase—a simple way to quantify an icing hazard", XP008182473, Ninth Conference on Aviation, Jan. 1, 2000, p. 266-269.
Donald McCann, "Large Versus Small Droplet Icing", XP055324736, Jan. 1, 2004.
Intellectual Property Office, GB1513395.2, Feb. 5, 2016, Search Report under Section 17.

* cited by examiner

Variables for a 2by2

M13=M23=M41=-M42
F1=F2=F3=F4

Polynomials definition – *Based on the concept of virtual open circuit*

Return loss $\alpha_r = S_{r,r}$ for $r \leq N$

Transmission $\beta_i = S_{r,i+N}$ for $i \leq N$

Isolation $\gamma_j = S_{rj}$ for $1 < j \leq N, \wedge r \neq j$

Feasibility condition $$|\alpha_r|^2 + \sum_{i=1}^{N} |\beta_i|^2 + \sum_{\substack{j=1 \\ j \neq r}}^{N} |\gamma_j|^2 = 1$$

Reference: ONET+BPF $$S_{\mathrm{ref}} = S_{\mathrm{ONET}} \cdot \mathrm{diag}\{S_{\mathrm{BPF}}\}$$

$$\sum_{h=1}^{N} \frac{1}{N} \left(|\alpha_{\mathrm{BPF},h}|^2 + |\beta_{\mathrm{BPF},h}|^2\right) = 1$$

Feasibility condition on cascade of ONET+BPF $$\sum_{i=1}^{N} |\beta_i|^2 = N|\beta|^2$$

$$\sum_{\substack{j=1 \\ j \neq r}}^{N} |\gamma_j|^2 = 0$$

$$\sum_{h=1}^{N} \frac{1}{N} |\alpha_{\mathrm{BPF},h}|^2 = |\alpha_{\mathrm{BPF}}|^2$$

$$\sum_{h=1}^{N} \frac{1}{N} |\beta_{\mathrm{BPF},h}|^2 = |\beta_{\mathrm{BPF}}|^2$$

Conditions: equal power splitting, filtering and perfect isolation

Polynomials produces same response of the ONET+BPF $$|\alpha|^2 + N|\beta|^2 = |\alpha_{\mathrm{BPF}}|^2 + |\beta_{\mathrm{BPF}}|^2 = 1$$

Direct polynomials relations!

$$|\alpha|^2 = |\alpha_{\mathrm{BPF}}|^2$$

$$|\beta|^2 = \frac{|\beta_{\mathrm{BPF}}|^2}{N}$$

$$M_{h,\mathrm{BPF}} = \frac{1}{\sqrt{g_h g_{h+1}}}$$

$$K_{u_i} = \frac{1}{\sqrt{2}} M_{2i,\mathrm{BPF}}$$

$$K_{u_i,u_{i+1}} = M_{2i+1,\mathrm{BPF}}$$

Figure 8

Coupling coefficients K are directly calculated from the g parameters of the low-pass filter prototype

MULTIPORT DISTRIBUTION NETWORK

RELATED APPLICATION

This application hereby claims priority under 35 U.S.C. § 119 to United Kingdom Application No. 1513395.2 filed 30 Jul. 2015, the contents of which are incorporated by reference herein in their entirety.

FIELD

The present invention relates to a multiport distribution network having input and output ports, wherein the multipart distribution network can be used to apply a filter transfer function between the input and output ports.

BACKGROUND

The importance of a hybrid coupler as a fundamental passive circuit is demonstrated by its broad employment in many telecommunication systems, both terrestrial and for space applications. Some common examples of the use of such circuits are power splitting networks, distribution networks, duplexers and antenna arrays.

In a typical configuration, a hybrid coupler is formed from several pieces of transmission line with impedances selected to create the desired power splitting and output phase distribution [1]. Very common examples of different types of hybrid coupler are the 90°, 3 dB quadrature coupler and the 180° rat-race coupler. Both of these devices are 2-input, 2-output networks with the property of producing, for the quadrature coupler, a 90° phase shift between the output ports and, for the rat-race coupler, alternatively a 180° or 0° phase shift between the output ports, depending on the chosen input port [1]. In addition, the output power splitting ratio can be arbitrarily adjusted according to the impedance of the transmission lines that form the hybrid coupler impedance [2]-[4].

The quadrature hybrid is generally formed by two coupled quarter-wave transmission lines, 2 straights and 2 shunts. However, more extensive synthesis techniques have been utilized to produce branch-guide couplers that satisfy various desired properties, such as number of branches, power splitting ratio, bandwidth and in-band transfer function [5]-[7].

In recent years, there has been increasing interest regarding the general synthesis of multi-port networks based on coupled resonators [8]-[11]. However, existing fully direct synthesis methods suffer from significant limitations, both in the definition of the polynomials of networks with more than 3 ports, and also for the maximum number of couplings that each resonator can sustain [12].

Modern techniques to synthesize a multi-port circuit, once the rational polynomials for the circuit are known, involve the synthesis of an equivalent transversal network and then the application of a sequence of matrix similarities (matrix rotations) in order to obtain the final topology [10]. This process is based on a conversion from the rational form of the scattering polynomials to the admittance matrix parameters, $[Y]_{ij}$, expressed as a ratio between the numerators $n_{ij}$ and a common denominator, $y_d$, as represented by the following partial fraction expansion notation:

$$[Y]_{ij} = \frac{n_{ij}}{y_d} = [Y^{\infty}]_{ij} + \sum_{h=1}^{n} \frac{r_{ij,h}}{s - j\lambda_h} \quad \text{(Eq. 1)}$$

where $[Y^{\infty}]_{ij}$ is the limit at infinity of the generic element of the admittance matrix, $r_{ij,h}$ is the residue associated with pole, $\lambda_h$, the complex low-pass frequency is $s=\sigma+j\omega$, and n is the order of the polynomial of the common denominator $y_d$.

The coupling matrix of a multi-port circuit based on resonators can be defined as $$M = \begin{bmatrix} M_p & M_{pn} \\ M_{np} & M_n \end{bmatrix}$$

where Mp is the sub-matrix of the couplings between pairs of external ports, Mpn is the sub-matrix of the coupling coefficients between external ports and internal resonators, and, finally, Mn is the sub-matrix of the coupling coefficients between pairs of internal resonators [13]. From Equation (1) above, the elements of matrices Mp, Mn and Mpn are obtained with direct formulas [13]. The formulas and conversion between the different types of matrices can be performed either analytically for some simple cases [11], or through numerical methods [14]. However, these techniques are valid mainly for multiplexing applications and, in particular, when the transfer function exhibits all single poles, [11]. However, if this last condition is not met, the method based on the derivation of the equivalent transversal network as per Equation (1) above brings singularities to its coupling matrix, thereby leading to a reduction of its columns/rows and thus to the elimination of some ports/resonators (see [11, 12]).

SUMMARY

The invention is defined in the appended claims.

Various embodiments of the invention provide a multipart distribution network that supports N inputs and N outputs, where N>1, the multipart distribution network providing an independent distribution path extending from each input to each output, each path being formed from a sequence of at least two fundamental units. Each fundamental unit comprises a circuit formed of multiple resonator cavities and having n input ports for receiving respective input signals, and n output ports for outputting respective output signals, where n>1, and wherein the circuit is configured to: (i) at each input port, split an input signal received at that input port into n equal signal components and provide each of the n signal components to a respective output port of the circuit; and (ii) at each output port, combine the signal components received from the n input ports to form an output signal for that output port. The multipart distribution network is configured to apply the same filter transfer function along each independent distribution path.

BRIEF DESCRIPTION OF THE DRAWINGS

Various embodiments of the invention will now be described in detail by way of illustration and example only, with reference to the following drawings.

FIG. 3A represents a 4×4 configuration and FIG. 3B represents an 8×8 configuration.

FIG. 8 illustrates the synthesis of a multi-port Butler matrix with inherent filtering in accordance with some embodiments of the invention.

FIG. 9A shows a generic path through the distribution network, comprising alternating hybrids and additional sub-networks. FIG. 9B shows a development of the circuit for a 4×4 configuration as shown in FIG. 3C in order to incorporate the additional sub-networks. FIG. 9C shows the filter transfer function of the distribution circuit of FIG. 9B (and is an analogous plot to FIGS. 4 and 7C).

DETAILED DESCRIPTION

Figure 1A:
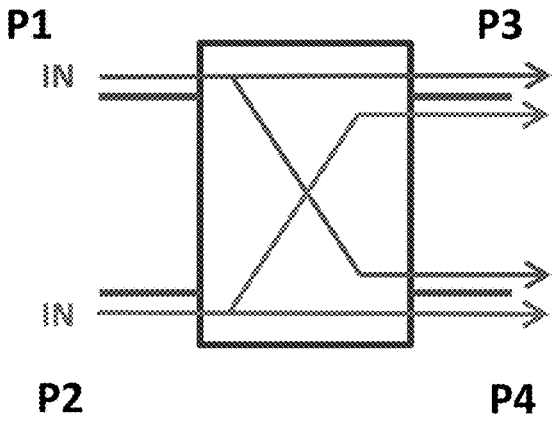
FIGS. 1A and 1B are schematic diagrams of a known Butler matrix, with FIG. 1A illustrating a circuit schematic, and FIG. 1B illustrating an example of a circuit implementation.
Figure 1B:
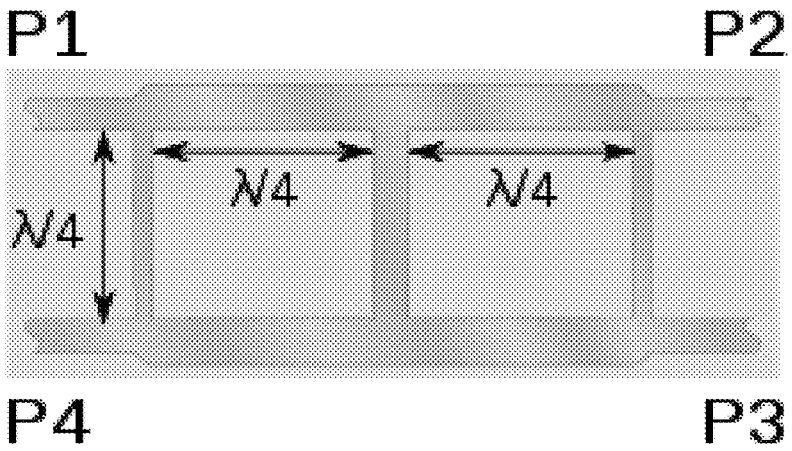

FIG. 1A is a simple schematic diagram of a simple conventional N×N multipart distribution network, with N=2, so that there are 2 inputs (P1, P2) and 2 outputs (P3, P4). Each input is split into two equal components which are then directed at a respective output port. Accordingly, each output P3, P4 is half the combined sum of the two inputs P1, P2. This type of configuration is sometimes referred to as a Butler matrix. FIG. 1B is a schematic diagram of an example of a known implementation of the Butler matrix of FIG. 1A comprising a configuration of transmission lines. This type of configuration is relatively broad-band in nature.

The present application provides an improved multiport distribution network, in which each of the input signals is operating inside an available spectra of the same operational bandwidth and centre frequency. Without defining yet the topology of the network, in such circumstances, the generally desired properties of the improved multiport distribution network can be summarised as follows:

1) mutually isolated input ports.
2) equal input power distribution among the outputs.
3) proper input to output phase distribution in order to allow recombination of the signals.
4) reciprocal network.
5) the same bandpass transfer function for all signals.

Note that equal power distribution among the outputs helps to ensure that there is a generally consistent level of signal within the network, so that the devices typically remain within their favoured range of operation. The phase distribution (offset or shift) between a given input and a given output will typically be ±90 degrees, based on the normal implementation of the device.

In order to satisfy the condition of having the same transfer function for all signals, it is not possible to exploit Equation (1) because of the higher multiplicity of roots of common denominator, $y_d$. Accordingly, a different method is adopted herein. In particular, a general method is described for the synthesis of any N×N multiport distribution network with a filter transfer function included. This approach exploits the virtual open circuit offered by the 180° hybrid coupler based on resonators [15], and hence avoids the problem of multiplicity of roots of $y_d$ that affects traditional techniques.

Figure 2A:
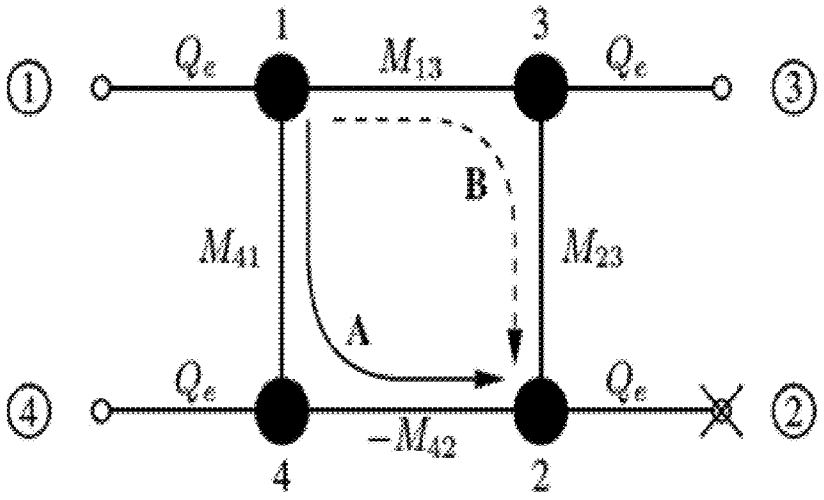
FIG. 2A is a schematic circuit diagram of a hybrid coupler based on coupled resonators.

FIG. 2A is a schematic diagram of a 180° hybrid coupler based on coupled resonators as described in [15]. In this FIG. 2A, the black points (circles) represent the resonators, all sharing the same central resonator frequency (hence F1=F2=F3=F4), while the lines between the black points represent the couplings. For each line, the corresponding coupling coefficient for the internal resonator couplings $M_{ij}$ is indicated, or the external quality factor $Q_e$ between a resonator and an external port (as appropriate). Note that $M_{ij}=M_{ji}$. As described in more detail below, if we apply input power to port 1, this causes port 2 to be isolated (as indicated by the X), where the isolation arises from destructive interference between the signals along path A (solid line) and path B (continuous line) that arrive at port 2.

Using the network of FIG. 2A, it is possible to synthesise a 180° hybrid coupler having inherent Tchebycheff filtering functions as described in [15], [16], by adopting the coupling coefficients $M_{13}=M_{23}=M_{41}=-M_{42}$. From the basic theory of filters, it is well-known that each coupling can be modeled as an emmittance inverter that introduces a phase shift of ±90° depending on the sign of the coupling [1].

Consider a signal entering at port 1 in the hybrid coupler of FIG. 2A. This signal is coupled to external ports 3 and 4 through couplings $M_{13}$ and $M_{41}$ respectively. However, part of the signal also propagates to resonator 2 through the paths A and B, as shown in FIG. 2A. As all the coupling coefficients have same sign, except for $M_{42}$ (which has same value, i.e. magnitude, but opposite sign), it follows that the contribution arriving at resonator 2 via path A is the same as, but with opposite phase to, the contribution arriving at resonator 2 via path B.

The sum of the two signals generates destructive interference at all frequencies. The consequence of this is that port 2 is fully isolated from the signal entering at port 1—and hence can be considered as a virtual open circuit.

The circuit of FIG. 2A can therefore be seen as a 3 dB power splitter formed by resonators 1, 3 and 4. In other words, paths 1-3 and 1-4 can be regarded as independent, parallel paths, with each path acting as a simple in-line bandpass filter. The paths 1-3 and 1-4 represent simple 2-pole filters, and the coupling coefficients $M_{13}$, $M_{14}$ for these paths can be calculated using known theory [15]. A further scaling factor of $1/\sqrt{2}$ is then applied to these coupling coefficients $M_{13}$, $M_{14}$ in order to satisfy the unitary condition (conservation of energy).

The network of FIG. 2A has various symmetries, and similar considerations to those discussed above are valid if a signal is applied to one of the other ports. Note that the output signals at ports 3 and 4 are in phase when the input signal is applied to port 1 (as shown in FIG. 2A). However, if the input signal is applied to port 2, then the output signals at ports 3 and 4 are out of phase, i.e. 180° phase shift (because of the negative sign of coupling $M_{42}$). Accordingly, resonator 1 then acts as a virtual open circuit in respect of the input from port 2 (for all frequencies).

The behaviour of the device shown in FIG. 2A generally matches the rat-race coupler discussed above, or the configuration of transmission lines shown in FIG. 1B, but with the addition of a band-pass characteristic resulting from the inclusion of resonators 1, 3 and 4. In particular, the transmission lines shown in FIG. 1B are, in effect, replaced by the four resonators and the couplings therebetween.

The device or network of FIG. 2A exhibits two identical filter functions (for the outputs at ports 3 and 4 respectively), with each filter function having two poles (while the network itself has 4 resonators). This behavior arises from the isolation at the port opposite to the input port, and the resulting virtual open circuit in the resonator associated with the port opposite to the input port i.e. at resonator 2 for input at port 1, or resonator 1 for input at port 2. The filter (transfer) function of this band-pass characteristic is defined by two poles, which are in turn determined by the central frequency of the resonators (the same frequency for all of them) and also the coupling coefficients of the resonators.

Figure 2B:
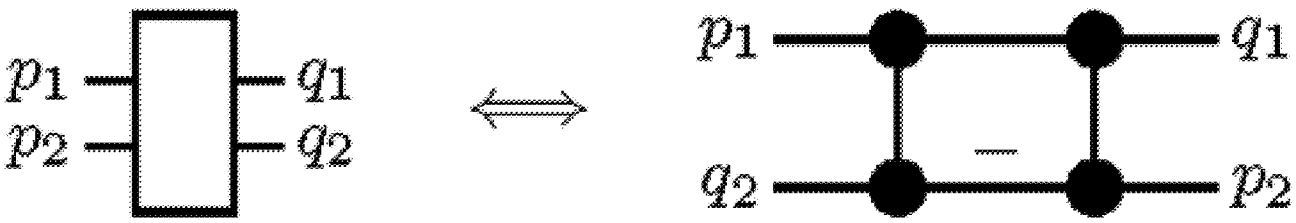
FIG. 2B is a schematic diagram of the hybrid coupler of FIG. 2A, representing it as a fundamental unit or building block for a distribution network in accordance with some embodiments of the present invention.

FIG. 2B shows two alternative, simplified schematic representations of the hybrid coupler of FIG. 2A. The diagram on the left is a basic schematic which represents the hybrid coupler as a simple rectangle. To the left of this hybrid coupler are shown two input ports, denoted p1 and p2 (these can be considered as corresponding to ports 1 and 2 in FIG. 2A). To the right of the hybrid coupler are shown two output ports, denoted q1 and q2 (these can be considered as corresponding to ports 3 and 4 in FIG. 2A). This schematic generally matches the schematic of a Butler matrix, such as shown in FIG. 1A.

The diagram on the right of FIG. 2B corresponds more directly to the coupler shown in FIG. 2A, in that it preserves the geometry of the resonators and ports. This makes it easier to see the transformation (and connection) between the hybrid coupler circuit shown in the FIG. 2A, and the schematic representation shown in FIG. 2B (left).

Note that because of the isolation between the two inputs p1, p2, we can regard the hybrid coupler as additive (linear). Accordingly, if a first input signal is applied to port 1, and a second input signal is applied to port 2, then the output on ports 3 and 4 is the (complex) sum of the outputs that would have been produced by the first and second inputs individually. In addition to the isolation between the two inputs (p1, p2), the hybrid coupler also provides equal power division for each input signal between the two outputs, q1 and q2, and a transfer matrix (filter properties) which can be adjusted (by appropriate selection of the properties of the resonator cavities 1, 2, 3 and 4 and their couplings) in accordance with the requirements of an application of interest.

Figure 3A:
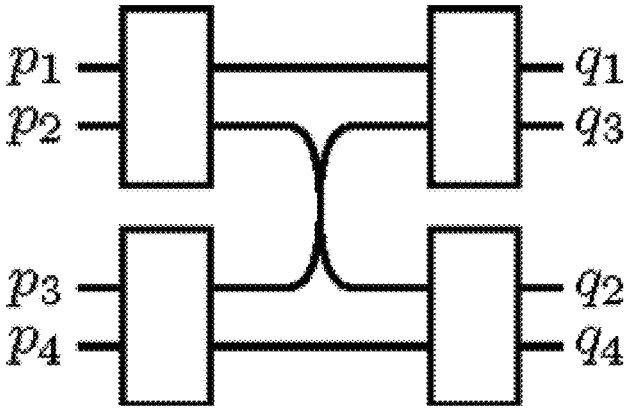
FIGS. 3A and 3B are schematic diagrams showing configurations of multiple fundamental units such as shown in FIG. 2B to form a distribution network in accordance with some embodiments of the present invention, whereby
Figure 3B:
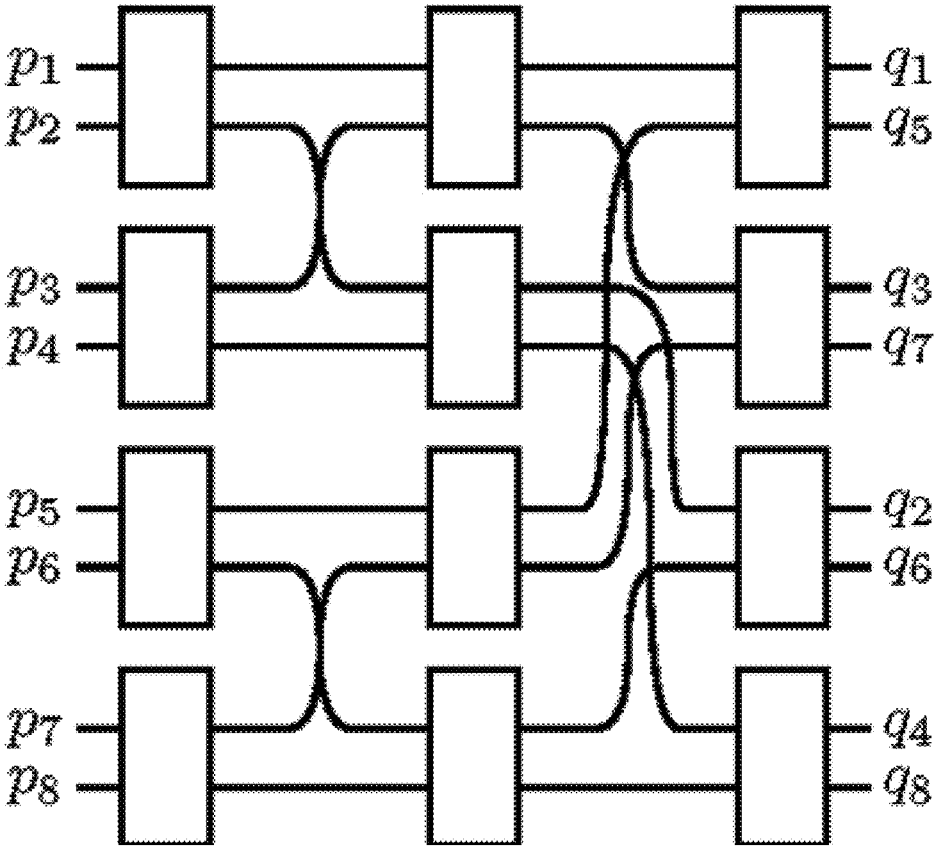

The circuit shown in FIGS. 2A and 2B can be regarded as a fundamental unit or building block for use in more complex distribution networks, such as shown in FIGS. 3A and 3B. Each rectangle in FIGS. 3A and 3B represents one of the fundamental units of FIG. 2B (left), and the lines joining these fundamental units represent an electromagnetic coupling, e.g. a transmission line. (Note that there is no connection where the lines cross one another, rather each line is independent of the other lines). The coupling device of FIG. 3A provides 4 inputs (denoted p1, p2, p3 and p4) and 4 outputs (denoted q1, q2, q3 and q4)—this is referred to as a 4×4 configuration. The coupling device of FIG. 3B provides 8 inputs and 8 outputs—this is referred to as an 8×8 configuration.

As can be seen in FIGS. 3A and 3B, the configurations of fundamental units provide a path from each input to each output. More particularly, there is a path from each fundamental unit that provides input ports for the overall circuit, to each fundamental unit that provides output ports for the overall circuit. Consequently, there is an independent path from each input port to each output port for the circuits shown in FIGS. 3A and 3B.

We can consider the entire network in FIG. 3A or FIG. 3B as a (rectangular) matrix of fundamental units, having N/2 rows and k columns, where N represents the total number of input ports for the entire network. The value of k is then given by $k=\log_2 N$, which ensures that there are enough columns of fundamental units to provide (independent) paths and equal power distribution between each input and each output. The total number of fundamental units (u) in a given circuit is given by $u=N/2\times k=N/2 \log_2 N$. The total number of resonators (n) in a given circuit is given by $4u=2N \log_2 N$. Note that in FIG. 3A, N=4, while in FIG. 3B, N=8. It will be appreciated that circuits for higher values of N (typically powers of 2) can be readily determined by extending the approach of FIGS. 3A and 3B (this can be done recursively).

Since each fundamental unit of FIG. 2B has two outputs, then the network can be considered as providing, for each input fundamental unit (on the left of the network as shown in FIGS. 3A and 3B), a binary tree of routings to every output fundamental unit (on the right of the network as shown in FIGS. 3A and 3B). This set of routings represents a form of Butler matrix which implements a Hadamard transfer matrix [17]. Although the output ports in FIGS. 3A and 3B have been numbered in an order to match the transfer matrix of [17], if a sequential numbering, e.g. from top to bottom, is applied to the networks of FIGS. 3A and 3B, the resulting transfer matrix can still be orthogonal.

Figure 3C:
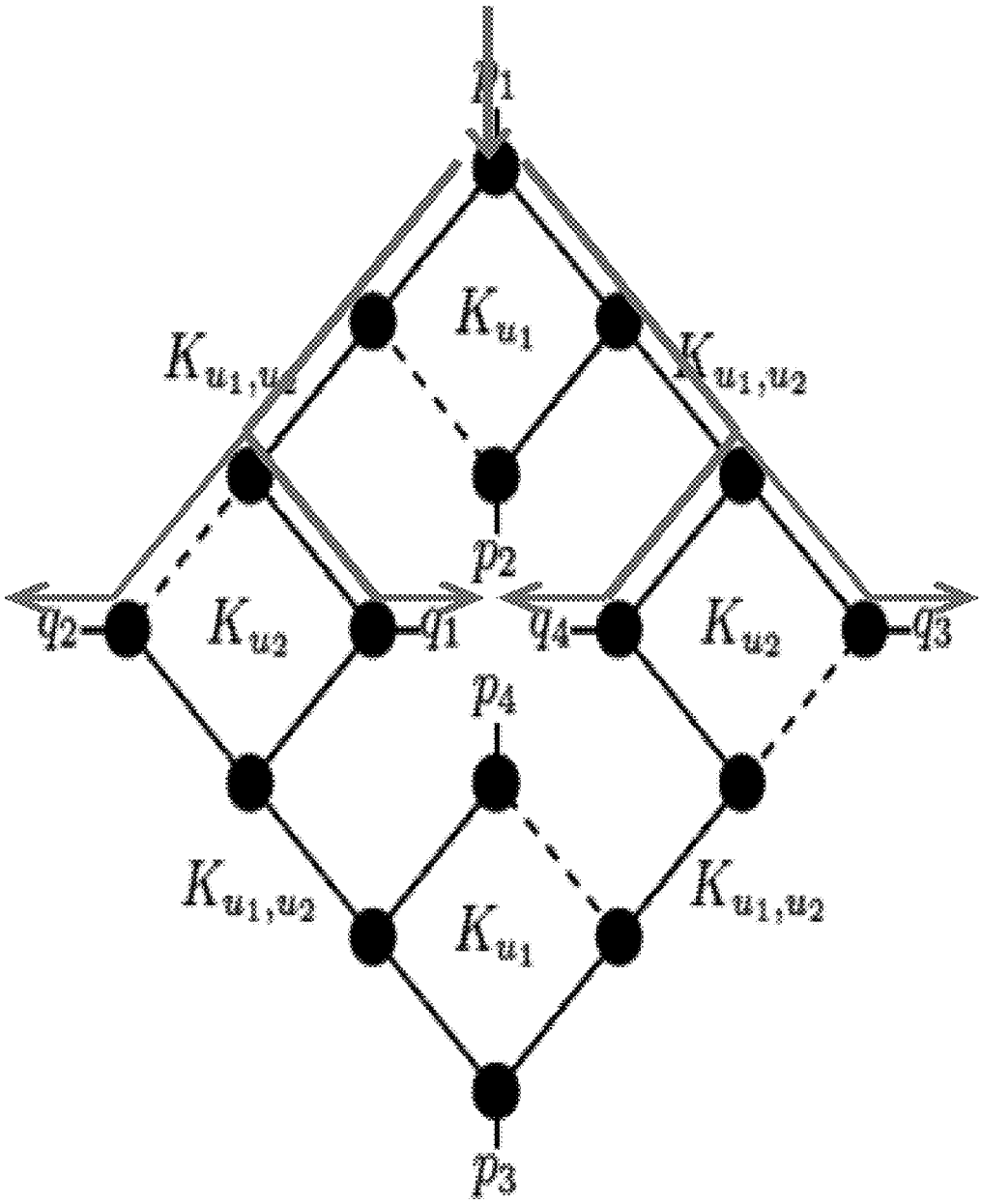
FIG. 3C illustrates how the 4×4 configuration of FIG. 3A may be implemented using an arrangement of four hybrid couplers, such as shown in FIG. 2A, in accordance with some embodiments of the invention.

FIG. 3C is an example implementation of a 4×4 distribution network such as shown in FIG. 3A. This diagram illustrates in detail how such a distribution network can be formed by connecting together a set of four hybrid couplers, each as shown in FIG. 2A, located in a square (or diamond) configuration. Note that in this diagram, the inverted or negative coupling in each hybrid coupler (corresponding to $-M_{42}$ in FIG. 2A) is shown with a dashed line. The general approach shown in FIG. 3C can be extended, as required to produce larger configurations, such as an 8×8 configuration as shown in FIG. 3B.

The circuit of FIG. 3C has two hybrid couplers (shown top and bottom) which each provide two inputs, namely p1 and p2 (top), and p3 and p4 (bottom). In addition, the two hybrid couplers (shown left and right) each provide two outputs, namely q1 and q2 (left), and q3 and q4 (right). Note that all four hybrid couplers are shown in FIG. 3C in effect in the same orientation, with inputs top/bottom, outputs left/right. The two hybrid couplers that provide inputs for the overall circuit (i.e. top and bottom) form the first column of fundamental units in FIG. 3A, while the two hybrid couplers that provide outputs for the overall circuit (i.e. left and right) form the second column of fundamental units in FIG. 3A.

There is an independent path from each input to each output. Accordingly, each path goes through a particular sequence of resonators and couplings that is unique to that given path. FIG. 3C shows (in green) the paths from input p1 to each of the four outputs, q1, q2, q3 and q4. In addition, FIG. 3C indicates the couplings along the different paths, in particular, $K_{u1}$ is the coupling within the first column of fundamental units (top/bottom), $K_{u2}$ is the coupling within the second column of fundamental units (left/right), and $K_{u1,u2}$ is the coupling between a fundamental unit in the first column and a fundamental unit in the second column. Note that each independent path comprises the same sequence of couplings, namely $K_{u1}$, then $K_{u1,u2}$, and finally $K_{u2}$, to provide a consistent filter function through the overall device.

In some situations it may be appropriate to change the inter-connections between the output ports of one column of the fundamental units and the input ports of the next column of the fundamental units (as moving from left to right in FIGS. 3A and 3B). For example, such a change might be motivated by practical constraints regarding implementation of the electromagnetic couplings between the resonators of different fundamental units. In general terms, this does not impact that the power division of the resulting Butler matrix (which is for even power across all output ports), however, it will usually impact the distribution of output phase across the various output ports. Even in such circumstances, the transfer matrix through the circuit will still permit the original input signals to be regenerated (if so desired) by an appropriate re-combination of the outputs. Overall, the facility to alter the topological configuration of the network gives greater design freedom, in that the response of the network is not limited to a pure Hadamard transfer matrix, but rather the designer has an ability to change the physical interconnections of the hybrids (fundamental units) while maintaining the desired properties of the circuit.

Since each fundamental unit provides a contribution of 2 poles to the overall path, the total transfer (filter) function achievable provides 2k poles. Note that all the fundamental units in a given column share the same coupling coefficients ($M_{12}$, $M_{41}$, etc), but the fundamental units in one column can have different coupling coefficients from the fundamental units in another column. Since each path through the network is formed from one fundamental unit from each of the k columns, and since all the fundamental units in a given column share the same 2 poles, this means that all paths share the same 2k poles overall (and hence provide the same filter response).

As discussed so far, the number of poles (2k) for defining the filtering transfer function may be directly related to the number of input ports N, since $k=\log_2 N$. However, in some cases it may be required to increase the order of the network to meet the desired filtering specifications—in effect, to increase the number of poles in the filter circuit to provide, e.g. a sharper cut-off, than would otherwise be available if the number of poles k was based on just the number of ports N as above.

This increase in selectivity can be achieved by incorporating one or more additional resonators into the ports of the hybrid coupler of FIG. 2A. In order the circuit to remain symmetric, the same number of resonators should be included also at the corresponding output port. The inclusion of these additional resonators does not impact the underlying operation of the hybrid circuit (the fundamental unit), since the virtual open circuit of the hybrid coupler of FIG. 2A continues to ensure isolation between the two input ports. However, the (filter) transfer function is now formed by a total of 2k+2v poles, where v is the number of resonators applied at each port.

Figure 4:
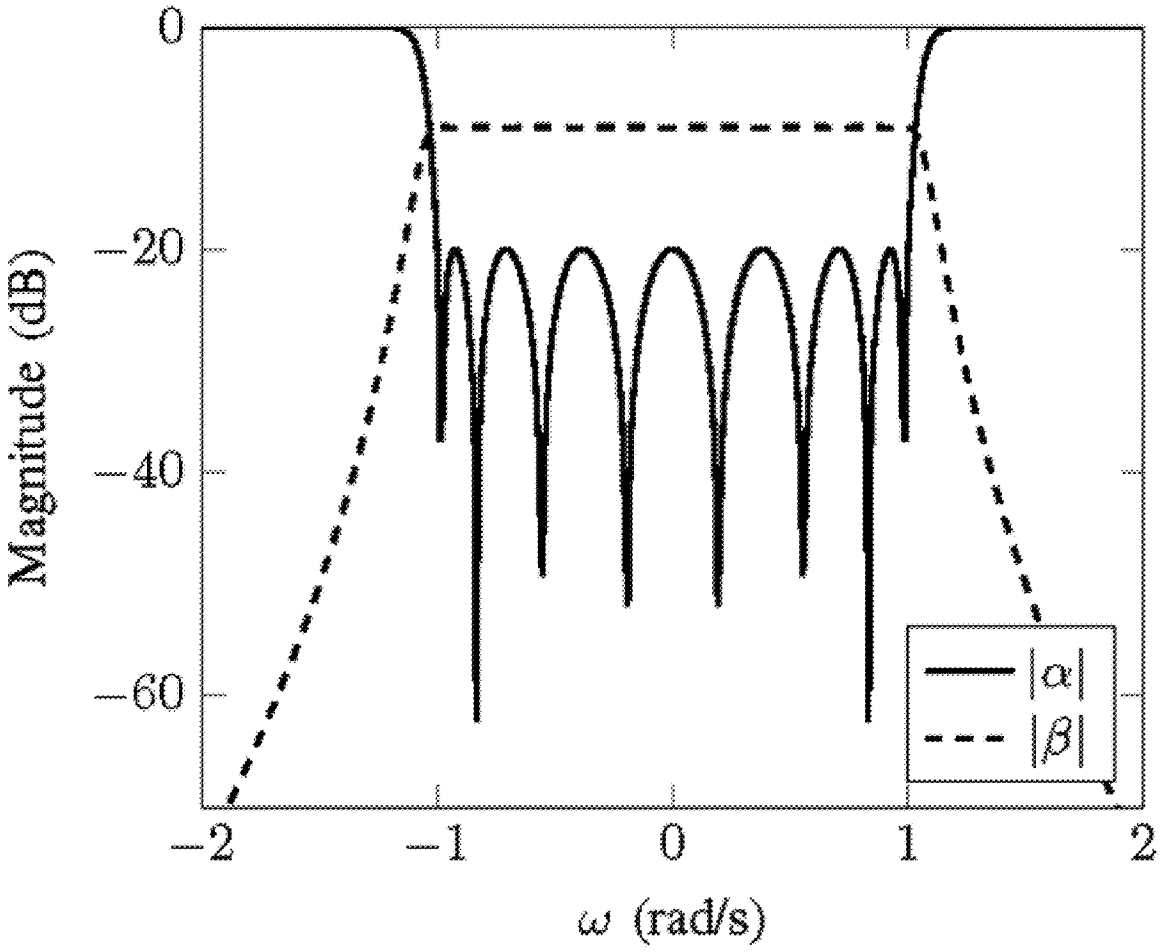
FIG. 4 presents simulated results for the transfer function of a distribution network in accordance with some embodiments of the present invention for an 8×8 configuration such as shown in FIG. 3B.

An example of the filter response for a Butler matrix such as described herein with integrated filter function, and with the inclusion of one resonator (v=1) at each port, is shown in FIG. 4. The plot shows the filter response in terms of reflection (α) and transmission (β) of an 8×8 Butler matrix (N=8,k=3) with 1 extra resonator (v=1) at each port and 20 dB return loss. There are 8 poles in the filter response (=2k+2u) and the total number of resonators required is 64.

The values of the coupling coefficients in this circuit are as follows:

M0=0.9907—this is the external coupling to an input port

M1=0.8222—this results from the extra resonator at the input ports

Ku1=0.4183—this is the coupling $M_{13}=M_{41}$, etc for the first column of fundamental units Ku2=0.3860—this is the coupling $M_{13}=M_{41}$, etc for the second column of fundamental units Ku3=0.4183—this is the coupling $M_{13}=M_{41}$, etc for the third column of fundamental units Ku1, u2=0.5537—this is the coupling between the $1^{st}$ and $2^{nd}$ columns of fundamental units Ku2, u3=0.5537—this is the coupling between the $2^{nd}$ and $3^{rd}$ columns of fundamental units (It will be appreciated that this represents an extension of the terminology used in FIG. 3C above).

Figure 5A:
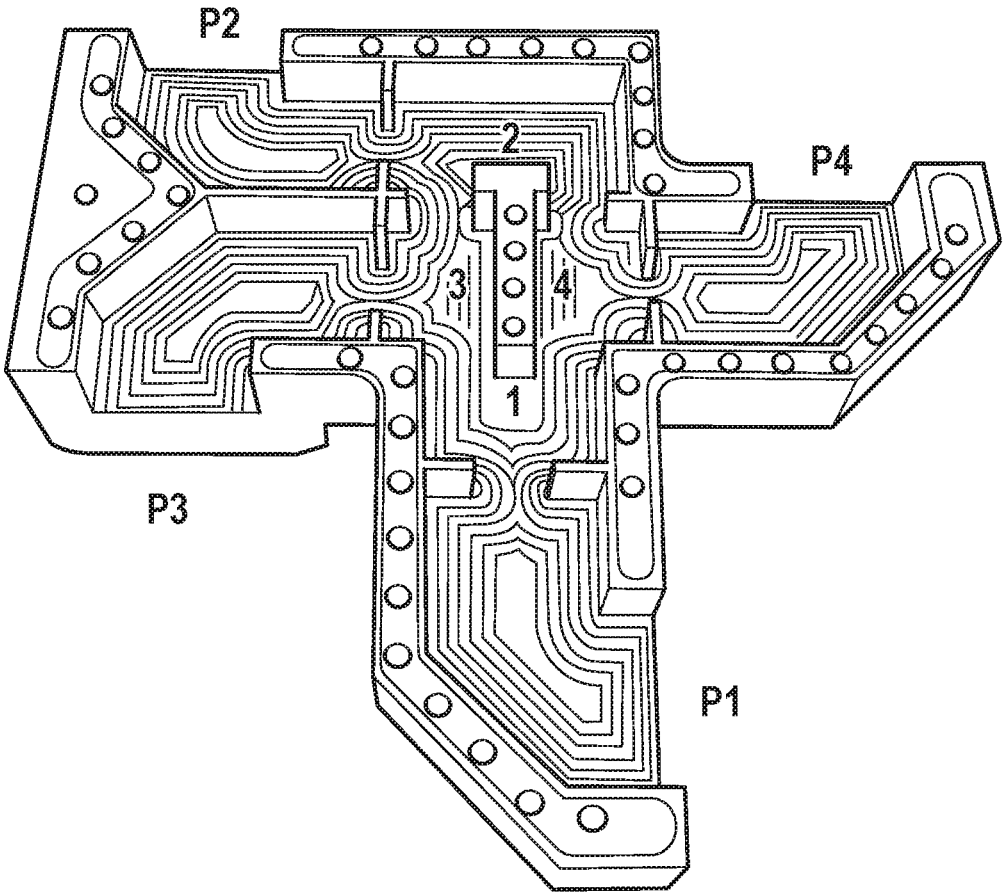
FIGS. 5A and 5B illustrate a hybrid coupler of the type shown in FIGS. 2A and 2B, with resonant cavities and induction couplings, where FIG. 5A and FIG. 5B respectively representing a picture and a schematic of the configuration of the hybrid coupler.
Figure 5B:
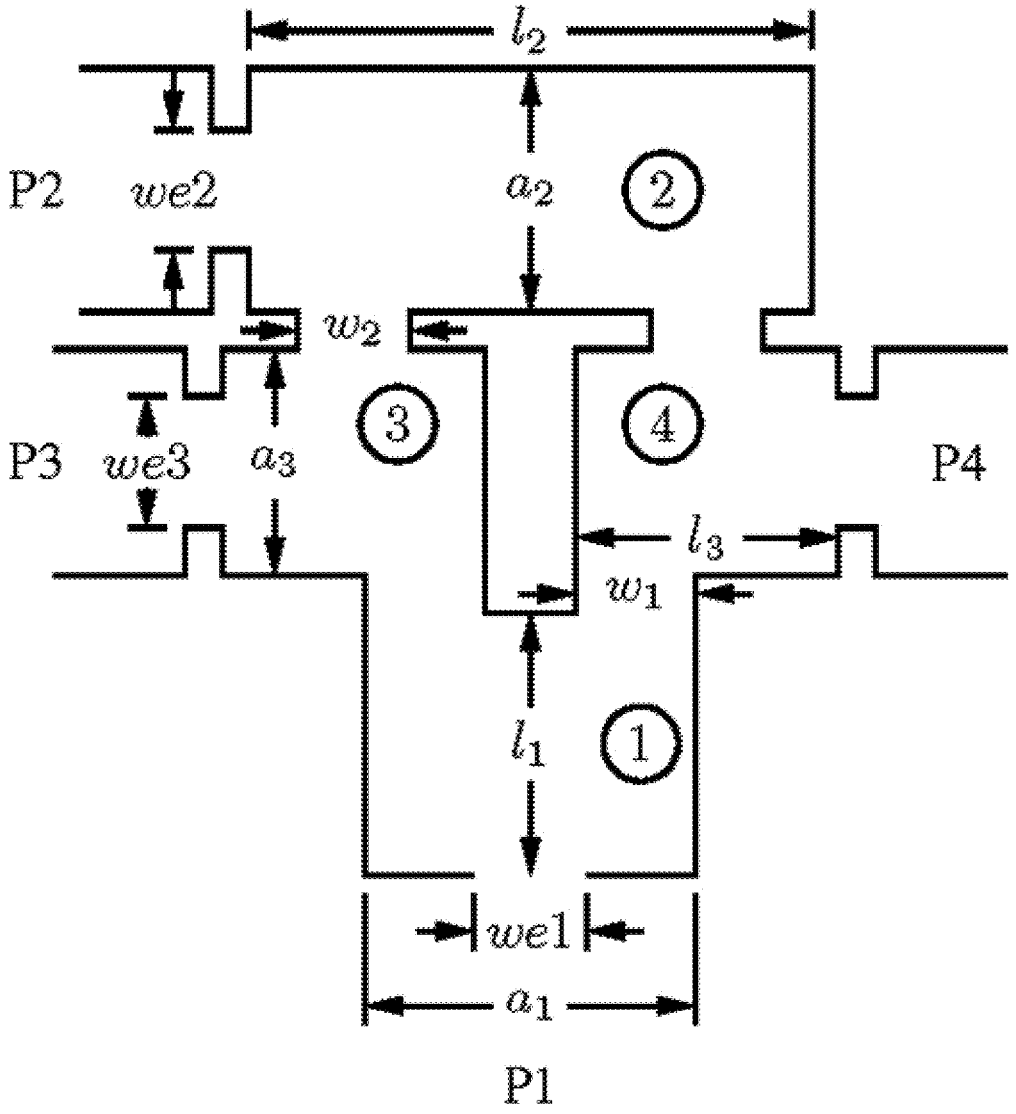

FIGS. 5A and 5B illustrate a 2×2 hybrid (rat-race coupler) with resonant cavities and inductive coupling and represents an implementation of the circuit shown in FIG. 2A. This is a basic hybrid coupler formed by 1 $TE_{102}$ and 3 $TE_{101}$ cavities in order to create the negative coupling. In particular, FIG. 5A is a photograph of an implementation having four resonant cavities, denoted 1, 2, 3 and 4, and respectively associated ports, denoted P1, P2, P3 and P4 (following the labelling in FIG. 2A). The circuit has been provided with four mitered bends in order to accommodate external flanges, e.g. for mounting. FIG. 5B is a top-view schematic of the device shown in FIG. 5A.

The device of FIGS. 5A and 5B has a centre frequency $f_0$ of 10 GHz, a return loss=25 dB, and a bandwidth=140 MHz and uses WR90 waveguide (0.9 inches). The dimensions in mm as shown in the diagram are: $a_1$=23.32; $I_3$=16.41; $w_{e1}$=10.27; $I_1$=14.70; $w_1$=9.65; $w_2$=8.33; $w_{e3}$=10.35; $w_{e2}$=11.75; $I_2$=32.24; $a_3$=22.86. (It will be appreciated that these dimensions are given by way of example only for one particular implementation, and will vary as appropriate for other devices).

FIGS. 6A-6D present radio frequency measurements (solid lines) for the hybrid coupler of FIGS. 5A and 5B compared with results from EM full wave simulations (dotted lines). In particular, FIG. 6A (top) shows the transmission scattering parameter (in absolute magnitude) between ports 3 and 1 ($|S_{31}|$), and between ports 2 and 1 ($|S_{21}|$); the return loss between port 1 and itself, ($|S_{11}|$), is also shown. The scattering and return loss are in line with a 2-pole Tchebycheff filter, with the return loss suitably low in the filter band-pass region. In addition, note that the isolation between the two inputs, as indicated by $S_{21}$, is below 25 dB.

Figure 6A:
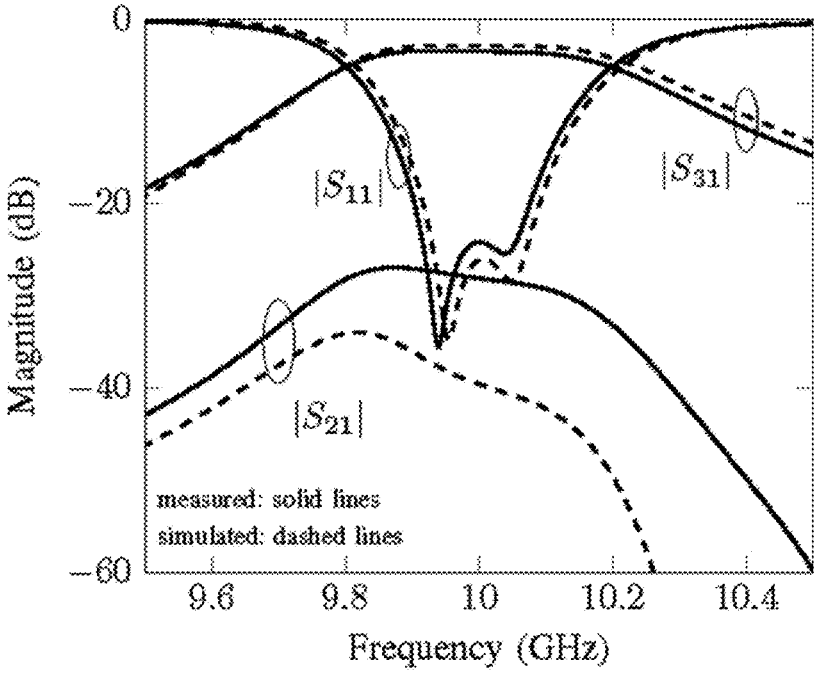
FIGS. 6A, 6B, 6C and 6D present radio frequency measurements (solid lines) and EM full wave simulations (dotted lines) for the hybrid coupler of FIGS. 5A and 5B, showing the magnitude of coupling between various ports (FIGS. 6A and 6B) and the phase relationship between various ports (FIGS. 6C and 6D).
Figure 6B:
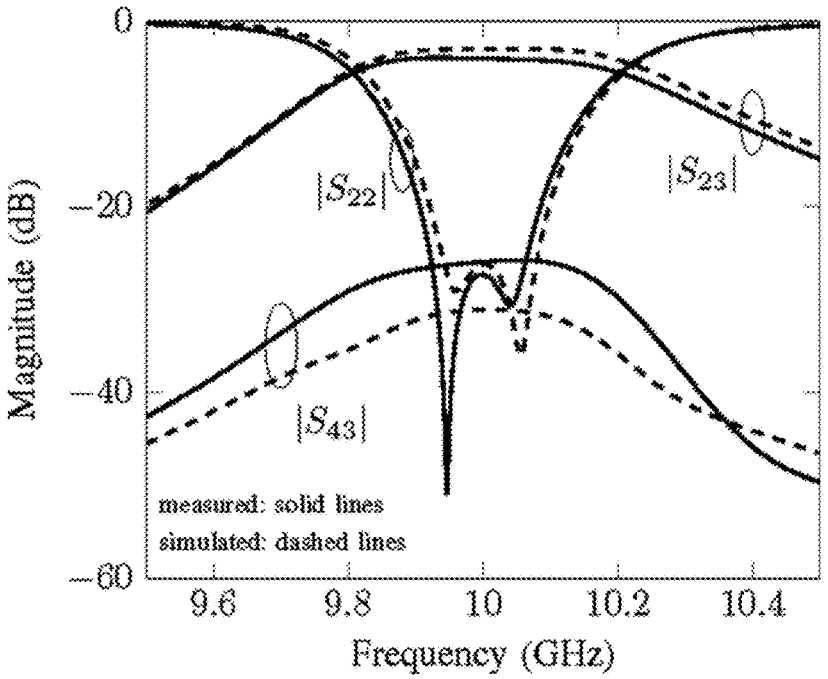

FIG. 6B shows generally analogous results (measured and simulated) for port 2, the other input port, in particular the transmission scattering parameter between ports 2 and 3 ($|S_{23}|$), and the return loss between port 2 and itself, ($|S_{22}|$). FIG. 6B further shows the isolation between the two outputs, as indicated by $S_{43}$, which is again below 25 dB.

Figure 6C:
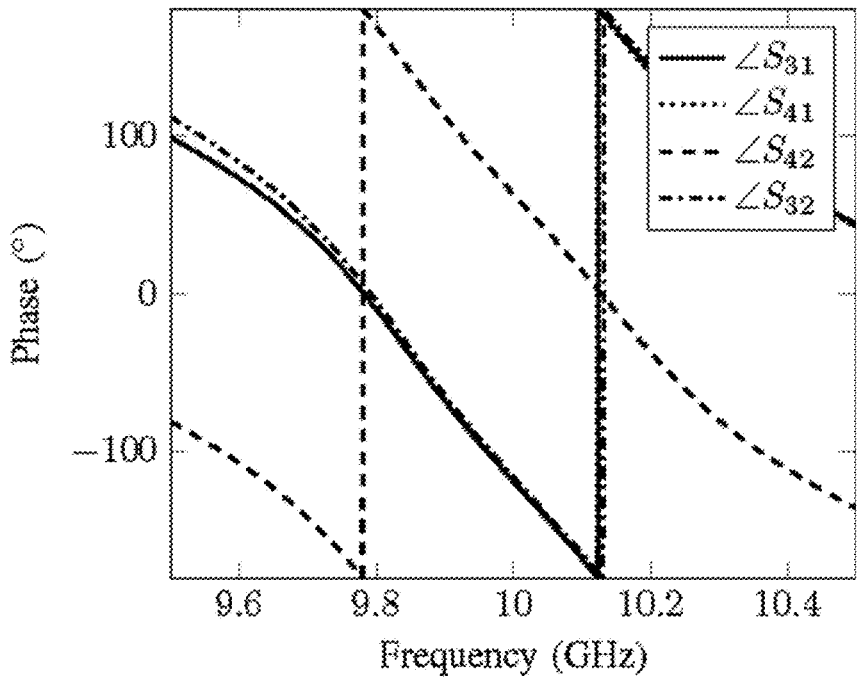

FIG. 6C shows the phase change associated with the various couplings. This clearly shows that there is a phase difference of 180 degrees associated with the coupling $S_{42}$, corresponding to the minus sign indicated for this coupling (as illustrated in FIG. 2A). As explained above, this shift of 180 degrees causes destructive interference, and hence the isolation between the two input ports 1 and 2.

Figure 6D:
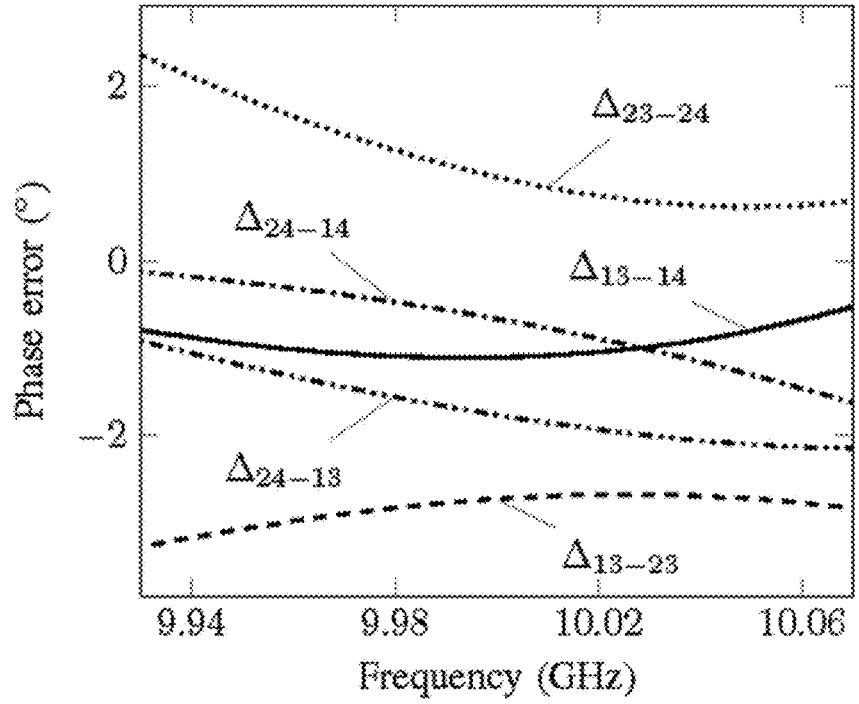

Lastly FIG. 6D shows examples of the phase difference between various pairs of couplings, where each individual coupling is from an input port to an output port. These couplings are all expected to be 90 degrees (in absolute terms), and so the differences between two such couplings are all expected to be zero (in an ideal case). The various lines in FIG. 6D therefore represent phase errors (in degrees) away from this ideal situation as a variation of frequency. It can see that the phase errors are generally small, less than 3 degrees for the lines plotted in FIG. 6D.

Figure 7A:
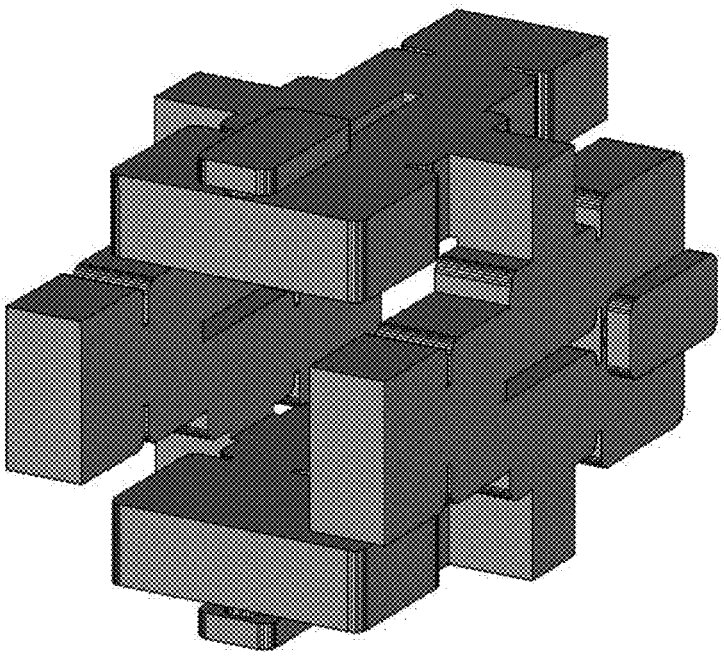
FIG. 7A shows a design schematic and FIG. 7B shows a potential physical implementation for a 4×4 configuration of a distribution network (such as shown in FIG. 3A) in accordance with some embodiments of the invention.
Figure 7C:
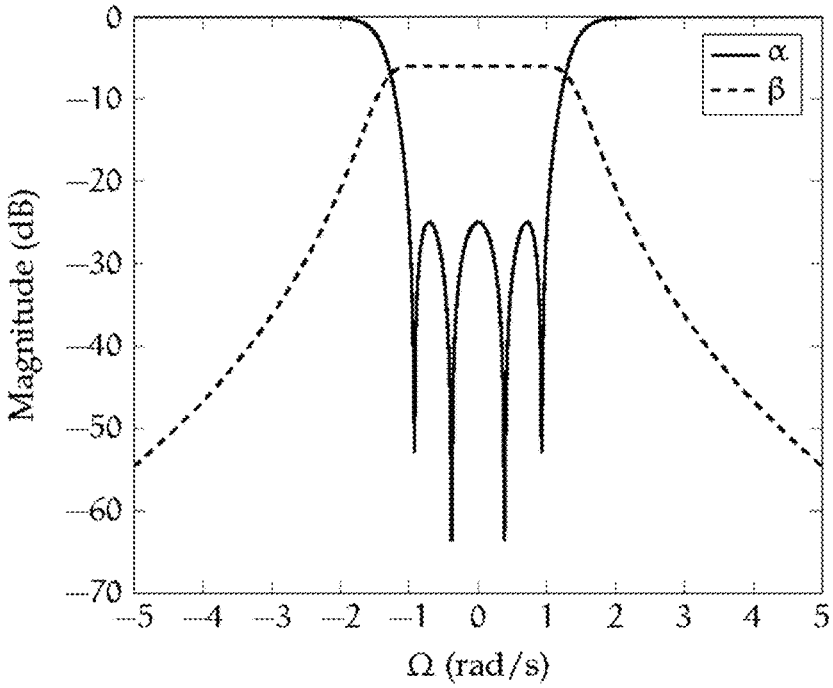
FIG. 7C shows the result of EM simulations for this distribution network, analogous to the simulated results plotted in FIG. 4 for an 8×8 configuration.
Figure 7B:
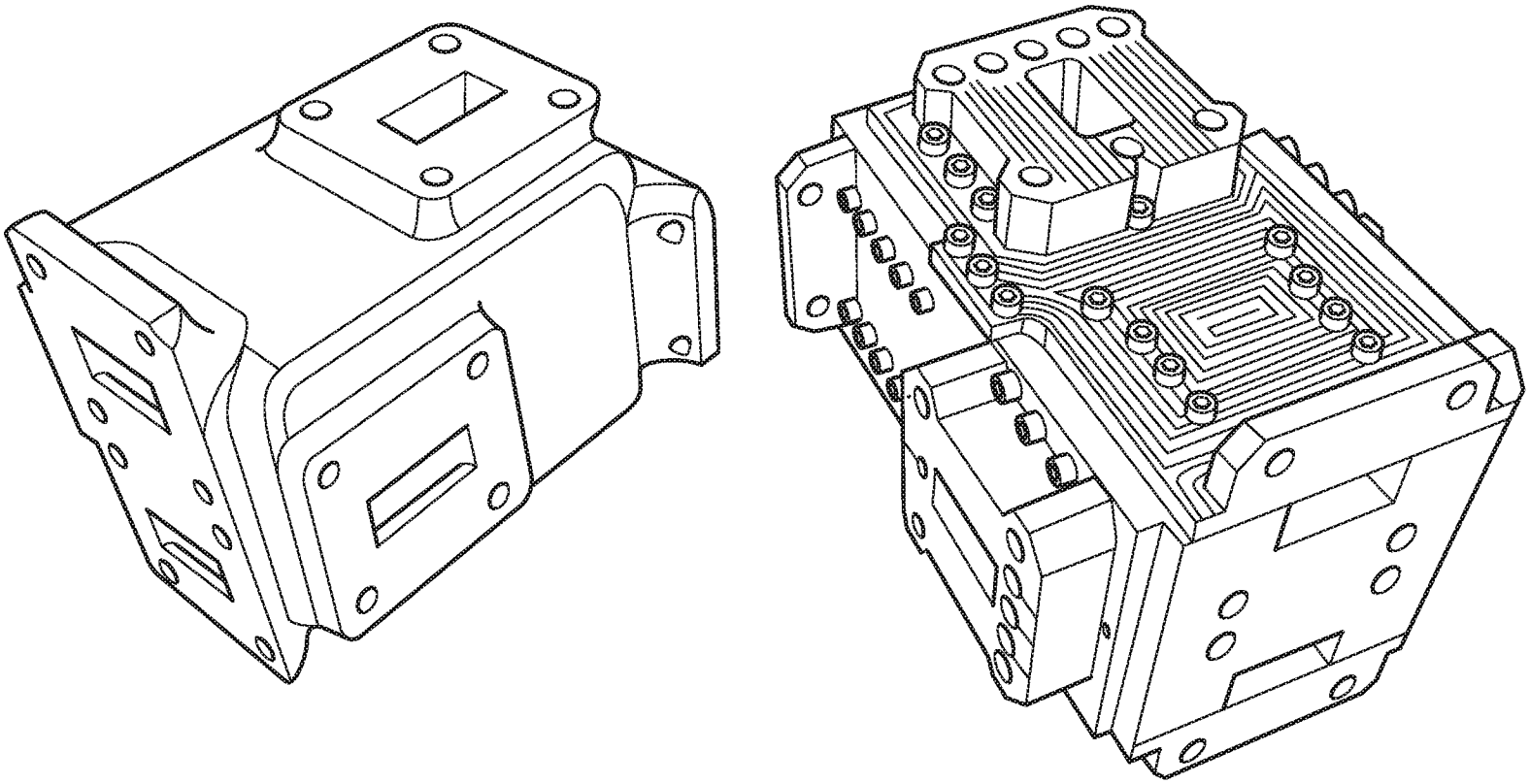

FIG. 7A presents a design construction based on waveguide technology and FIG. 7B presents a physical implementation of a 4×4 configuration, such as shown in FIG. 3A, comprising four fundamental units. This circuit is intended for use in the Ku-band with 500 MHz of bandwidth. The results from EM full wave simulations are shown in FIG. 7C, which shows a filter response from this simulation (analogous to the plot of FIG. 4). The response shows a good Tchebycheff 4-pole equal ripple response with a return loss better than 25 dB.

FIG. 8 illustrates the synthesis of a multi-port Butler matrix with inherent filtering as described herein, in accordance with some embodiments. The parameters return loss, transmission and isolation are specified in accordance with their normal definitions, and this leads directly to the feasibility condition, which in effect represents the conservation of energy. In particular, all energy incident at a port must be reflected (returned), transmitted, or leak into another port (the isolation loss).

The multi-port Butler matrix with inherent filtering can be regarded as a conventional Butler matrix (acting as an ONET, see below) followed by a (separate) filter on each output of the Butler matrix. This leads to the feasibility condition bottom left, which represents conservation of energy in the situation that each signal is first divided by N (as per the Butler matrix), and then passes through a separate band-pass filter (BPF).

The central (hexagonal) set of equations then represents the targeted conditions for the multiport distribution circuit described herein, namely equal distribution of power from any input to each output (top condition), and perfect isolation (second top condition). Furthermore, the same bandpass filtering is to be applied equally to each independent path (hence various inputs all have the same overall transmission and return loss).

We now (i) equate the two expressions on the left hand side of each feasibility condition (since both equal 1), and (ii) substitute in the conditions from the central set of equations. This leads to the equation: $|\alpha|^2+N|\beta|^2=|\alpha_{BPF}|^2+|\beta_{BPF}|^2=1$, which in turn indicates that direct polynomial relations can be derived, namely: $:|\alpha|^2=|\alpha_{BPF}|^2$ and $:N|\beta|^2=|\beta_{BPF}|^2$.

Accordingly, the coupling coefficients, such as illustrated in FIG. 3C can be determined from the g parameters of the desired low-pass filter prototype. The relevant formulae are shown in the box bottom right, and in particular, link the coupling coefficients both within a hybrid circuit, indicated as $Ku_i$, and also between hybrid circuits, indicated as $Ku_i$, $u_{i+1}$, to the g parameters of the desired low-pass filter.

As described above, each hybrid circuit introduces two (equal) resonators to each path through the hybrid circuit, and the number of hybrid circuits along a path is dependent on N, the number of input ports. One way of increasing the number of hybrid circuits on a path, and hence the number of poles in the filter response function (which may be appropriate for some applications) is to form a larger configuration—e.g. go from 4×4 to 8×8, but not use all of the input ports for the circuit. However, this is may be inefficient, since the distribution network becomes more complex than it really needs to be. A better way of increasing the number of poles in the filter response function, as already mentioned above, is to include resonators (or more complex network structures) at the inputs and/or outputs of individual hybrid circuits.

Figure 9A:
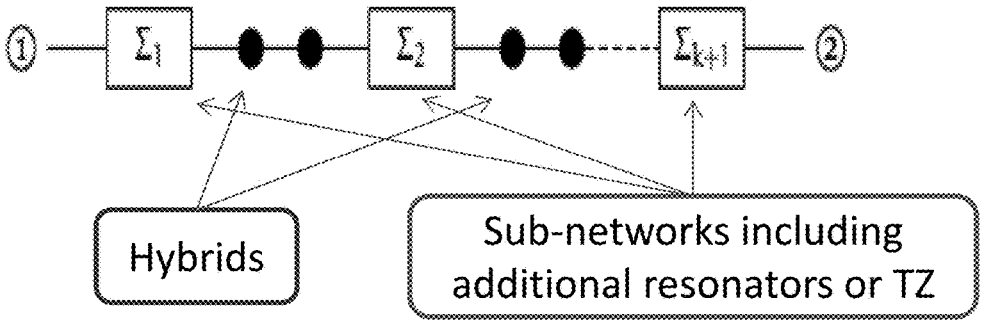
FIGS. 9A-9C illustrate how additional filtering components may be inserted between the hybrid couplers in accordance with some embodiments of the invention. In particular.
Figure 9B:
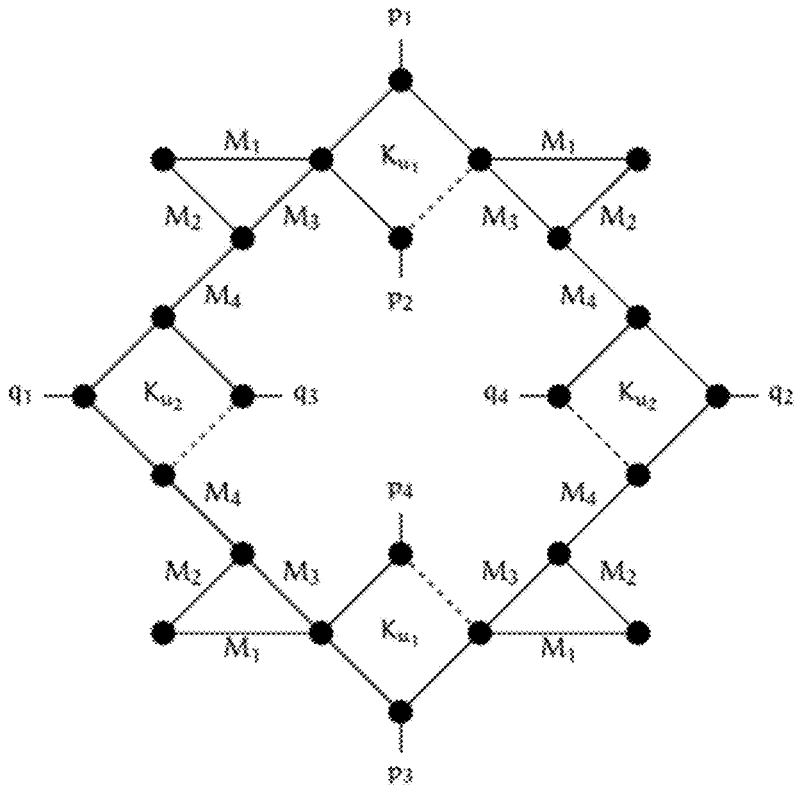
Figure 9C:
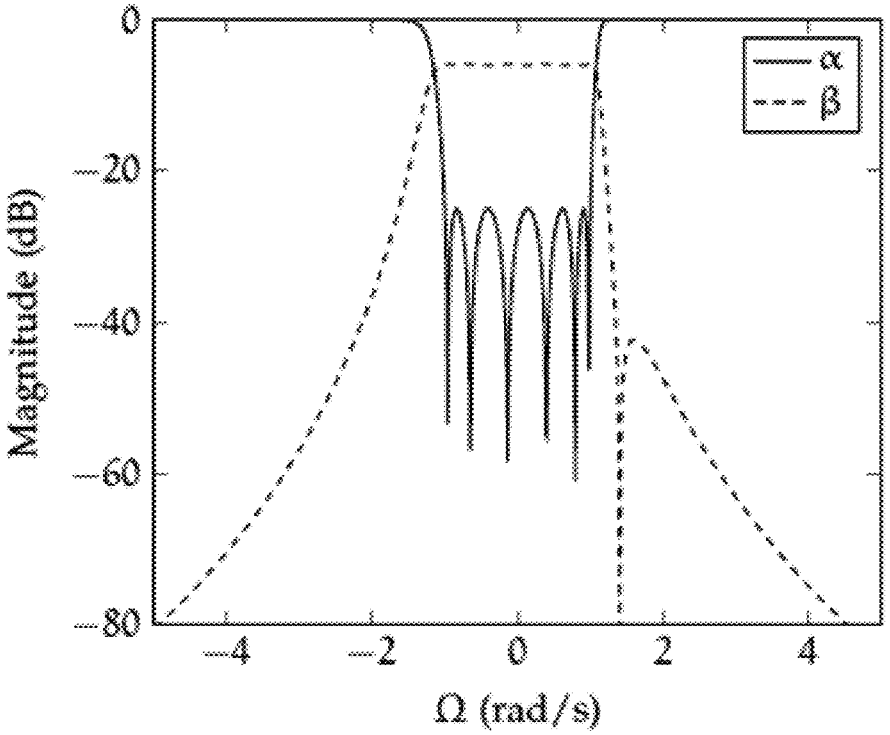

FIGS. 9A-9C illustrate how additional filtering components may be inserted between the hybrid couplers in accordance with some embodiments of the invention. In particular, FIG. 9A shows a generic path through the distribution network, comprising alternating hybrids and additional sub-networks. Each hybrid coupler contributes two resonators to the path. Additional subnetworks may be located before and/or after each hybrid coupler. Thus if k fundamental units are located along each independent path through the distribution network, a total of k+1 additional subnetworks may be incorporated if so desired. (It will be appreciated that there is at least a simple coupling between the relevant fundamental units to provide the necessary signal path through the distribution network).

Each sub-network may be just a simple coupling, such as for the configuration shown in FIG. 3C, a resonator, or a more complex combination of resonators and (cross-)couplings. These subnets allow additional poles and transmission zeroes to be incorporated into each independent path through the distribution network.

FIG. 9B shows a development of the circuit for a 4×4 configuration as shown in FIG. 3C in order to incorporate the additional sub-networks in accordance with some embodiments of the invention. In this particular implementation, an additional sub-network has been included on each path between a fundamental unit in the first column and a fundamental unit in the second column. This additional sub-network provides two additional resonators, and overall contributes an extra two poles to the filter transfer function, to produce a 6-pole filter (based on 2×2 poles for the hybrid couplers, plus 2 further poles for the additional sub-networks). Note that the additional sub-networks do not impact the basic operation of the fundamental unit (the underlying virtual open circuit of the hybrid coupler), but in effect insert additional filtering in the links between the fundamental units (and/or at the overall input and/or output of the distribution network).

FIG. 9C shows the filter transfer function of the distribution circuit of FIG. 9B (and is an analogous plot to FIGS. 4 and 7C). This transfer function is based on the following couplings: $M_0=1.1011$; $M_1=0.5475$; $M_2=0.5084$: $M_3=0.3405$; $M_4=0.6448$, and $K_{u1}=K_{u2}=0.6617$. In this context, $M_0=1.1011$ is the coupling at the input ports, while $M_1$, $M_2$, $M_3$ and $M_4$ correspond to and effectively replace (in combination) $K_{u1,u2}$ as discussed above in relation to FIG. 3C.

It will be appreciated that a circuit such as shown in FIGS. 9A and 9B can be synthesized using the same general approach as shown in FIG. 8, with the synthesis now being based on the overall band-pass filter seen along each line or path (such as depicted in FIG. 9A). As an example, consider an 8×8 Butler matrix that implements a Tchebycheff transfer function with a 20 dB return loss. The 8×8 Butler matrix of FIG. 3B will generally have 2n=6 poles, but we symmetrically add 1 resonator at the beginning and end of each filter path (the other sub-networks are just simple couplings between the different columns of the distribution network). The synthesis of this configuration reduces to the calculation of a simple in-line prototype with the g constants and the coupling coefficients shown in the Table below.

| h | g | $M_{h,BPF}$ |
|---|---|---|
| 0 | 1 | |
| 1 | 1.0189 | 0.990683 |
| 2 | 1.45177 | 0.822214 |
| 3 | 1.96825 | 0.591576 |
| 4 | 1.65697 | 0.553736 |
| 5 | 2.02518 | 0.545897 |
| 6 | 1.61038 | 0.553736 |
| 7 | 1.77439 | 0.591576 |
| 8 | 0.833644 | 0.822214 |
| 9 | 1.22222 | 0.990683 |

The first column of hybrids (fundamental units) is identified by resonators 2-3, the second by resonators 4-5, and the third by resonators 7-8. Resonator 1 is additionally located at the input port, resonator 8 is additionally located at the output port. The coupling between the first and second column of hybrids is denoted 3-4, and the coupling between the second and third column of hybrids is denoted 5-6. The coupling coefficients in the normalized low-pass domain are again directly derived from the Table as follows: $M_{1,BPF}$=0.9907 (external coupling); $M_{2,BPK}$=0.08222 (extra resonator); $K_{u1}$=0.4183; $K_{u2}$=0.3860; $K_{u3}$=0.4183; $K_{u1,u2}$=0.5537; $K_{u2,u3}$=0.5537. The power splitting is equal to 9 dB for an 8×8 Butler matrix.

Figure 10A:
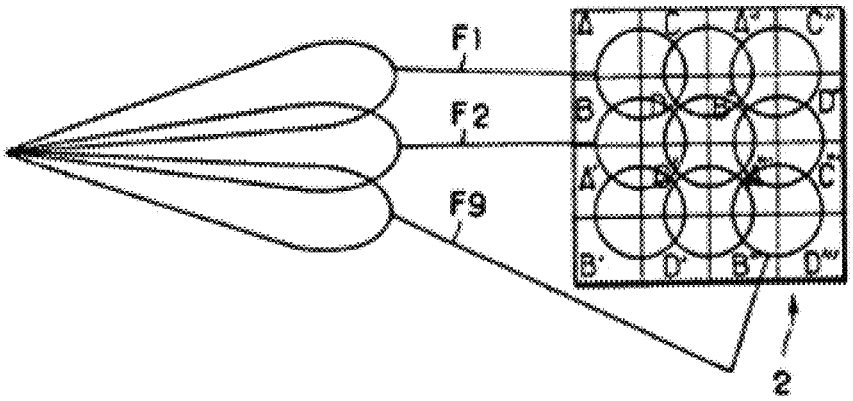
FIGS. 10A and 10B illustrate the use of a Butler matrix for producing multiple communication beams from a satellite, which represents a potential application for the multiport distribution network described herein.
Figure 10B:
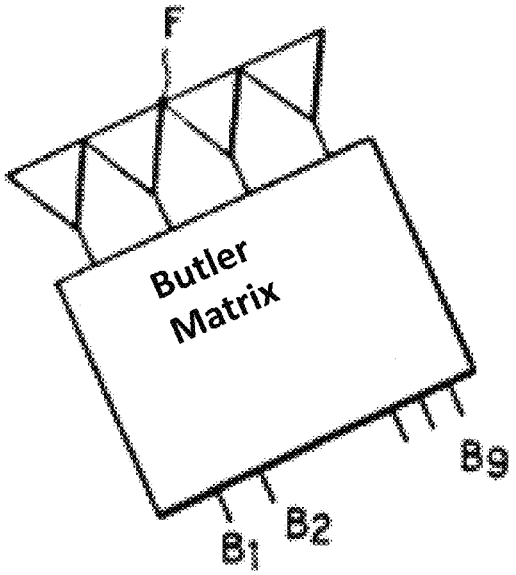

FIGS. 10A and 10B illustrate one application of the multiport distribution network described herein for a communication or broadcast satellite. In particular, FIG. 10A illustrates a situation in which different beams F1, F2, . . . F9 are transmitted by a single satellite into different geographical areas on the earth's surface. FIG. 10B illustrates how these beams may be generated by using a Butler matrix, which can be implemented using a multipart distribution network as described herein. For example, this Butler matrix may be implemented by forming a 16×16 configuration (but only using the appropriate number of inputs and outputs).

Figure 11:
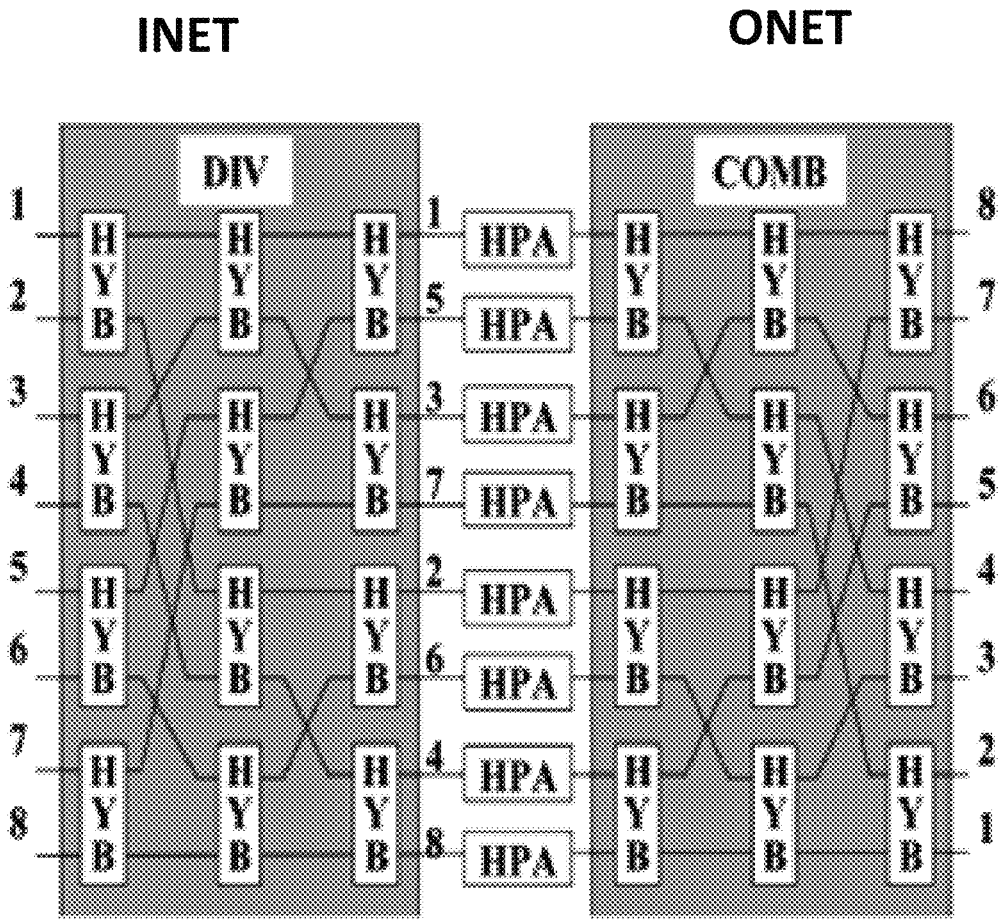
FIG. 11 shows a known multi-port power amplifier (MPA) which represents another potential application for the multiport distribution network described herein.

FIG. 11 illustrates another application of the multipart distribution network described herein. In particular, FIG. 11 shows a known multi-port power amplifier (MPA) in which the initial signals are split by an NET circuit, multiplied by a set of high-powered amplifiers (HPA), and then recombined into the original (but now amplified) signals by an ONET circuit. Compared with direct use of one HPA per signal (i.e. without the ONET/INET arrangement), this splitting and recombination of signals helps to provide resilience against the failure of any individual HPA.

The INET and ONET circuits used for the signal division and recombination in FIG. 11 represent Butler matrices. In known systems, they are generally implemented using an arrangement of hybrid couplers, but this does not provide any frequency selectivity. Thus if any such filtering is required this is typically performed by an array of filters—one filter on each output line. However, the multipart distribution network described herein could be used to implement the ONET (and/or the INET) as an integrated device to act both as a Butler matrix and also as a filter, thereby avoiding the need for multiple filters, one on each line.

The present application has described a particular form of a fundamental unit which can be incorporated into a distribution network, but other forms may potentially be used. Likewise, the N×N configuration of the distribution network described herein may potentially be varied according to the circumstances of any given implementation. In conclusion, various embodiments of the invention have been described herein. The skilled person will be aware that these embodiments are provided by way of example only, and will be understand and recognise further possible modifications and adaptations according to the circumstances of any given implementation. Accordingly, the present invention is defined by the appended claims and their equivalents.

REFERENCES

[1] D. Pozar, Microwave Engineering, 4th ed. John Wiley & Sons. Inc., 2012.

[2] H. Riblet, "A mathematical theory of directional couplers", Proc. IRL. vol. 35. no. 11, pp. 1307-1313, November 1947.

[3] J. Reed and G. Wheeler, "A method of analysis of symmetrical four port networks", IRE Trans. Microw. Theory Tech., vol. 4, no. 4, pp. 246-252, October 1956.

[4] G. Luzzatto. "A general 180-degree hybrid ring", IEEE Trans. Broadcasting, vol. BC-14, no. 1, pp. 41-43. 1968.

[5] R. Levy and L. Lind, "Synthesis of symmetrical branch-guide directional couplers", IEEE Trans. Microw. Theory Tech., vol. 19, no. 2, pp. 80-89, February 1968.

[6] L. Lind,"Synthesis of asymmetrical branch-guide directional coupler impedance transformers (correspondence)", IEEE Trans. Microw. Theory Tech., vol. 17, no. 1, pp. 45-48, January 1969.

[7] R. Levy, "Zolotarev branch-guide couplers", IEEE Trans. Microw. Theory Tech., vol. 21, no. 2, pp. 95-99, February 1973.

[8] F. Loras-Gontalez, I. Hidalgo-Carpintero, S. Sobrino-Arias, A. Garcia-Lamperez, and M. Salazar-Palma, "A novel ku-band dielectric resonator triplexer based on generalized multiplexer theory", in Microwave Symposium Digest (MTT), 2010 IEEE MTT-S International, 52010, p. 1.

[9] A. Garcia-Lamperez, M. Salazar-Palma, and T. Sarkar, "Compact multiplexer formed by coupled resonators with distributed coupling", in Antennas and Propagation Society International Symposium, 2005 IEEE, vol. 1A, 7 2005, pp. 89-92.

[10] A. Garcia-Lamperez, S. Llorente-Romano, M. Salazar-Palma, and T. Sarkar, "Efficient electromagnetic optimization of microwave filters and multiplexers using rational models'", Microwave Theory and Techniques, IEEE Transactions on. vol. 52, no. 2, pp. 508-521, 2004.

[11] S. Tamiazzo and G. Macchiarella, "Synthesis of duplexers with the common port matched at all frequencies", Microwave Theory and Techniques, IEEE Transactions on, vol. 62, no. 1, pp. 46-54, 2014.

[12] F. Seyfert, O. Olivi, S. Bila. and H. Ezzeddine, "Nevanlinna pick interpolation and multiplexer synthesis", in Workshop Notes W14: Adv. N-port Netw. Space Appl. Eur. Microw. Conf., 11 2012, pp. 1-18.

[13] A. Garcia Lamperez and M. Salazar Palma, "Analytical synthesis of coupling matrices for n-port networks with reactance compensation", in Workshop Notes W14: Adv. N-port Netw. Space Appl. Eur. Microw. Conf., 11 2012. pp. 1-34.

[14] D. Traina, G. Macchiarella, and T. Sarkar. "Robust formulations of the cauchy method suitable for microwave duplexers modeling", Microwave Theory and Techniques, IEEE Transactions on, vol 55, no. 5, pp. 974-982, 2007.

[15] C.-K. Lin and S.-J. Chung, "A compact filtering 180° hybrid", Microwave Theory and Techniques, IEEE Transactions on, vol. 59, no. 12. pp. 3030-3036, 2011.

[16] H. Uchida, N. Yoneda, Y. Konishi, and S. Makino, "Bandpass directional couplers with electromagnetically-coupled resonators", in Microwave Symposium Digest, 2006, IEEE MTT-S International, 6 2006, pp. 1563-1566.

[17] S. Egami and M. Kawai, "An adaptive multiple beam system concept", Selected Areas in Communications, IEEE Journal on, vol. 5, no. 4, pp. 630-636, 5 1987.

What is claimed is:

1. A multiport distribution network, comprising:

N inputs and N outputs, where N>1;

an independent distribution paths extending from each of the N inputs to each of the N outputs, each independent distribution path being formed from a sequence of at least two fundamental units, wherein each of the at least two fundamental units comprises a circuit formed of multiple resonator cavities and having n input ports and n output ports, where n>1, and wherein the circuit is configured to: (i) at each of the n input ports, split an input signal received at that input port into n equal signal components and provide each of the n signal components to a respective one of the n output ports of the circuit; and (ii) at each of the n output ports, combine the signal components received from the n input ports to form an output signal for that output port, and wherein the multiport distribution network is configured to apply a same filter transfer function along each of the independent distribution paths.

2. The multiport distribution network of claim 1, wherein the fundamental units are formed with a logical grid arrangement having rows and columns, where each of the independent distribution paths consists of one fundamental unit from each of the columns.

3. The multiport distribution network of claim 2, wherein the fundamental units in one of the columns are all the same as one another.

4. The multiport distribution network of claim 2, wherein a first fundamental unit of the at least two fundamental units in one of the columns differs from a second fundamental unit of the at least two fundamental units in another of the columns such that the same filter transfer function is formed as a desired filter transfer function.

5. The multiport distribution network of claim 3, wherein adjacent fundamental units of the at least two fundamental units along one of the independent distribution atlaspaths are linked by a subnetwork.

6. The multiport distribution network of claim 5, wherein the same subnetwork is located between any fundamental unit of the at least two fundamental units in one of the columns and any fundamental unit of the at least two fundamental units in the next one of the columns in the logical grid arrangement.

7. The multiport distribution network of claim 5, wherein one or more of the subnetworks comprise simple couplings.

8. The multiport distribution network of claim 5, wherein one more of the subnetworks include a resonator.

9. The multiport distribution network of claim 5, wherein one more of the subnetworks include a combination of resonators and cross-couplings.

10. The multiport distribution network of claim 5, wherein an additional subnetwork may also be located at the input and/or output of the multiport distribution network.

11. The multiport distribution network of claim 1, wherein $N=n^k$, where k is an integer greater than one.

12. The multiport distribution network of any preceding claim, wherein the multiport distribution network implements a Butler matrix.

13. The multiport distribution network of claim 1, wherein the N inputs are mutually isolated.

14. The multiport distribution network of claim 1, wherein power from each of N input signals received at a respective input of the N inputs of the multiport distribution network is equally divided between the N outputs.

15. The multiport distribution network of claim 1, wherein each of the independent paths is configured to maintain a predetermined relationship between the a phase of each of the N input signals as received at a respective input of the N inputs of the multiport distribution network.

16. The multiport distribution network of claim 1, wherein each of the at least two fundamental units contributes multiple poles to the same filter transfer function of one of the independent path distribution paths which includes that fundamental unit.

17. The multiport distribution network of claim 1, wherein the same filter transfer function represents a Tchebycheff filter.

18. The multiport distribution network of claim 1, wherein n=2.

19. The multiport distribution network of claim 1, wherein the multiple resonator cavities of each of the at least two fundamental units comprise coupled resonators which are configured to form a virtual open circuit.

20. The multiport distribution network of claim 19, wherein the multiple resonator cavities of each of the at least two fundamental units comprise 4 resonators having a same central frequency.

21. The multiport distribution network of claim 20, wherein if the 4 resonators are denoted R1, R2, R3 and R4, then R1 is coupled to R3 by coupling M13, R1 is coupled to R4 by coupling M14, R3 is coupled to R2 to coupling M32, and R4 is coupled to R2 by coupling M42, and wherein: (i) $M13=M14=|M32|=|M42|$ and (ii) $M32=-M42$.

22. The multiport distribution network of claim 21, wherein two of the N input ports are coupled respectively to R1 and R2, and two of the N output ports are coupled respectively to R3 and R4.

23. The multiport distribution network of claim 1, wherein the multiport distribution network is part of an INET circuit.

24. The multiport distribution network of claim 1, wherein the multiport distribution network is part of an ONET circuit.

25. The multiport distribution network of claim 1, wherein the multiport distribution network is part of an INET circuit and/or an ONET, which is part of a multiport power amplifier.

26. A method for producing a multiport distribution network, wherein the multiport distribution network, comprises:

N inputs and N outputs, where N>1;

independent distribution paths extending from each of the N inputs to each of the N outputs, each independent distribution path being formed from a sequence of at least two fundamental units, wherein each of the at least two fundamental units comprises a circuit formed of multiple resonator cavities and having n input ports and n output ports, where n>1, and wherein the circuit is configured to: (i) at each of the n input ports, split an input signal received at that input port into n equal signal components and provide each of the n signal components to a respective one of the n output ports of the circuit; and (ii) at each output port, combine the signal components received from the n input ports to form an output signal for that output port, wherein the multiport distribution network is configured to apply a same filter transfer function along each of the independent distribution paths, and wherein each of the independent distribution paths is considered as an in-line band-pass filter and is synthesized using direct polynomial relations based on a desired transmission and return loss parameters of the in-line band-pass filter.

* * * * *